US010279464B1

(12) United States Patent
Wilshaw

(10) Patent No.: US 10,279,464 B1
(45) Date of Patent: May 7, 2019

(54) SOCKET WRENCH STORAGE CASE

(71) Applicant: Thomas Wilshaw, Spotsylvania, VA (US)

(72) Inventor: Thomas Wilshaw, Spotsylvania, VA (US)

( * ) Notice: Subject to any disclaimer, the term of this patent is extended or adjusted under 35 U.S.C. 154(b) by 0 days.

(21) Appl. No.: 15/906,203

(22) Filed: Feb. 27, 2018

(51) Int. Cl.
*B25H 3/00* (2006.01)

(52) U.S. Cl.
CPC ..... *B25H 3/006* (2013.01); *B25H 3/003* (2013.01)

(58) Field of Classification Search
CPC ..... B25H 3/006; B25H 3/003; B25H 3/04; B25H 3/06; A47F 5/0062; A47F 7/145
USPC ..... 206/374, 443, 379, 372, 373, 377, 378, 206/380; 211/128.1
See application file for complete search history.

(56) References Cited

U.S. PATENT DOCUMENTS 3,405,377 A * 10/1968 Pierce ..... B25B 13/56 206/378
5,129,528 A * 7/1992 Eidsmoe ..... B25H 3/003 211/69
5,511,673 A 4/1996 Folk
5,848,694 A 12/1998 Newton
6,044,985 A 4/2000 Kao
6,679,390 B1 1/2004 Wallen
7,424,953 B2 9/2008 McCarty
D774,765 S 12/2016 Hsieh
9,522,467 B1 12/2016 Kao
2004/0084342 A1 5/2004 Chang

FOREIGN PATENT DOCUMENTS

WO 9414683 A 7/1994

* cited by examiner

*Primary Examiner* — Andrew D Perreault

(57) ABSTRACT

The socket wrench storage case is a storage apparatus. The socket wrench storage case comprises a rectilinear block, a plurality of ports, and one or more adaptors. The plurality of ports are formed in the rectilinear block. Each of the plurality of ports are defined to receive a drive fitting selected from the group consisting of a drive fitting of an adaptor selected from the one or more adaptors, the wrench handle drive fitting, and the wrench extension drive fitting. Each individual adaptor selected from the one or more adaptors attaches the rectilinear block to a socket rail selected from the group consisting of the first socket rail drive fitting, the second socket rail drive fitting, and the third socket rail drive fitting.

15 Claims, 4 Drawing Sheets

SOCKET WRENCH STORAGE CASE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shaping and hand tools including workshop storage, more specifically, a storage arrangement facilitating access to work tools or instruments.

SUMMARY OF INVENTION

The socket wrench storage case is a storage apparatus. The socket wrench storage case is configured for use with a wrench handle. The wrench handle is further defined with a wrench handle drive fitting. The socket wrench storage case is configured for use with a wrench extension. The wrench extension is further defined with a wrench extension drive fitting. The socket wrench storage case is configured for use with a first socket rail. The first socket rail is further defined with a first socket rail drive fitting. The socket wrench storage case is configured for use with a second socket rail. The second socket rail is further defined with a second socket rail drive fitting. The socket wrench storage case is configured for use with a third socket rail. The third socket rail is further defined with a third socket rail drive fitting. The socket wrench storage case comprises a rectilinear block, a plurality of ports, and one or more adaptors. The plurality of ports is formed in the rectilinear block. Each of the plurality of ports is configured to receive a drive fitting selected from the group consisting of a drive fitting of an adaptor selected from the one or more adaptors, the wrench handle drive fitting, and the wrench extension drive fitting. Each individual adaptor selected from the one or more adaptors attaches the rectilinear block to a socket rail selected from the group consisting of the first socket rail drive fitting, the second socket rail drive fitting, and the third socket rail drive fitting.

These together with additional objects, features and advantages of the socket wrench storage case will be readily apparent to those of ordinary skill in the art upon reading the following detailed description of the presently preferred, but nonetheless illustrative, embodiments when taken in conjunction with the accompanying drawings.

In this respect, before explaining the current embodiments of the socket wrench storage case in detail, it is to be understood that the socket wrench storage case is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the socket wrench storage case.

It is therefore important that the claims be regarded as including such equivalent construction insofar as they do not depart from the spirit and scope of the socket wrench storage case. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
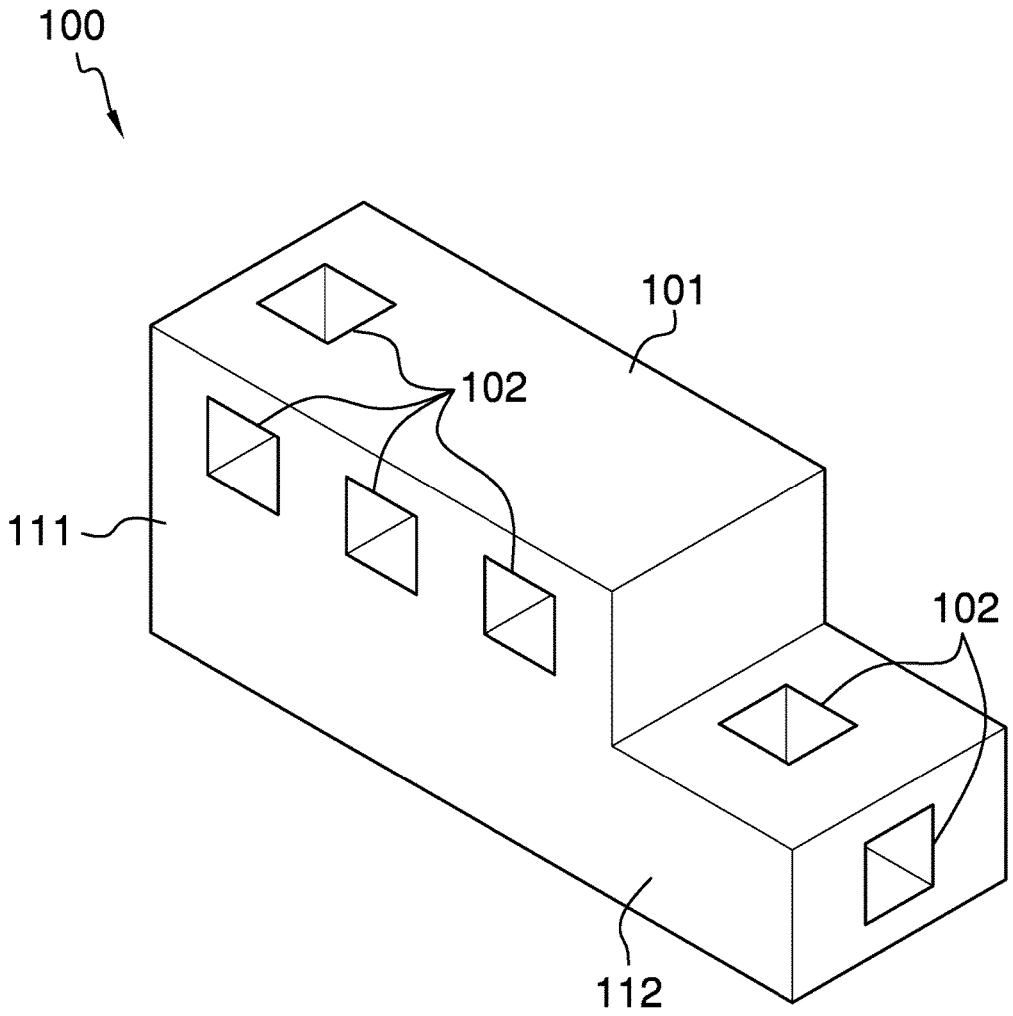
FIG. 1 is a perspective view of an embodiment of the disclosure.
Figure 2:
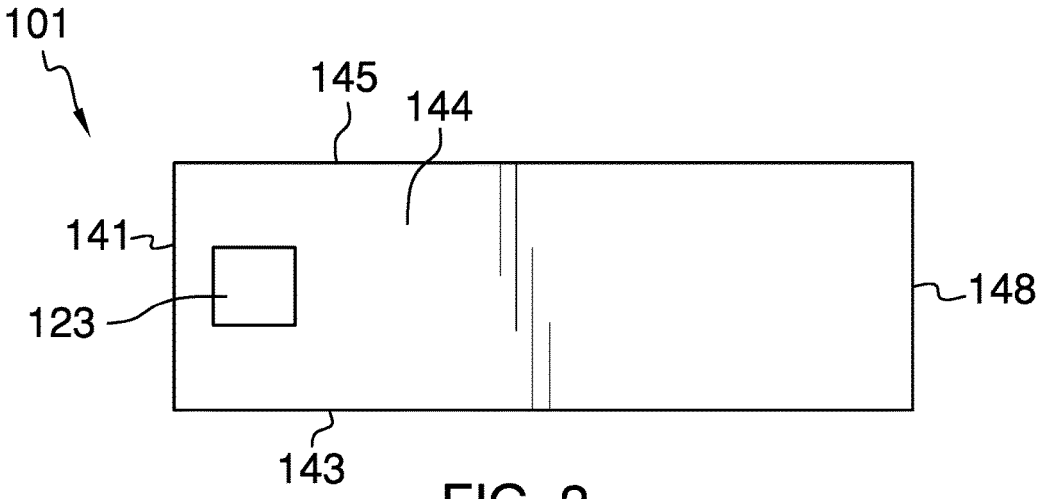
FIG. 2 is a bottom view of an embodiment of the disclosure.
Figure 3:
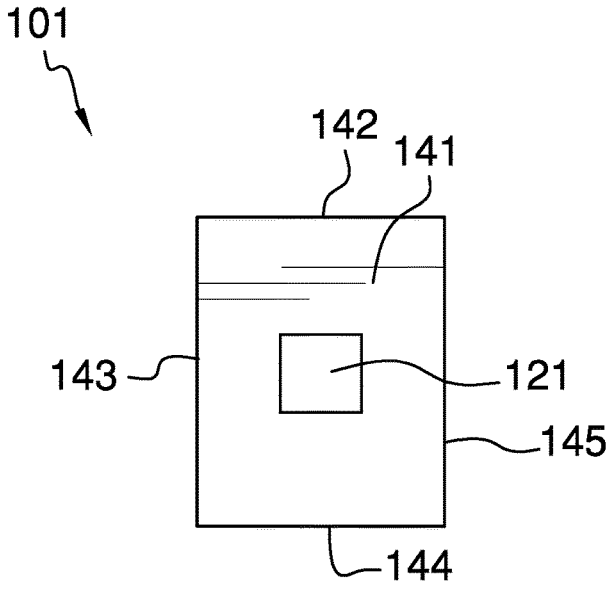
FIG. 3 is a rear view of an embodiment of the disclosure.
Figure 4:
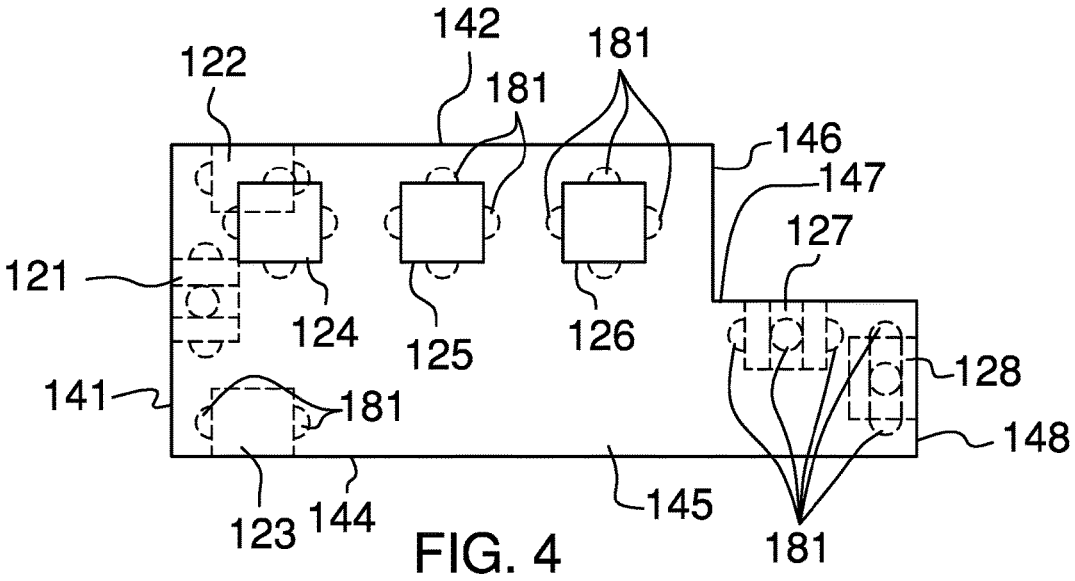
FIG. 4 is a side view of an embodiment of the disclosure.
Figure 5:
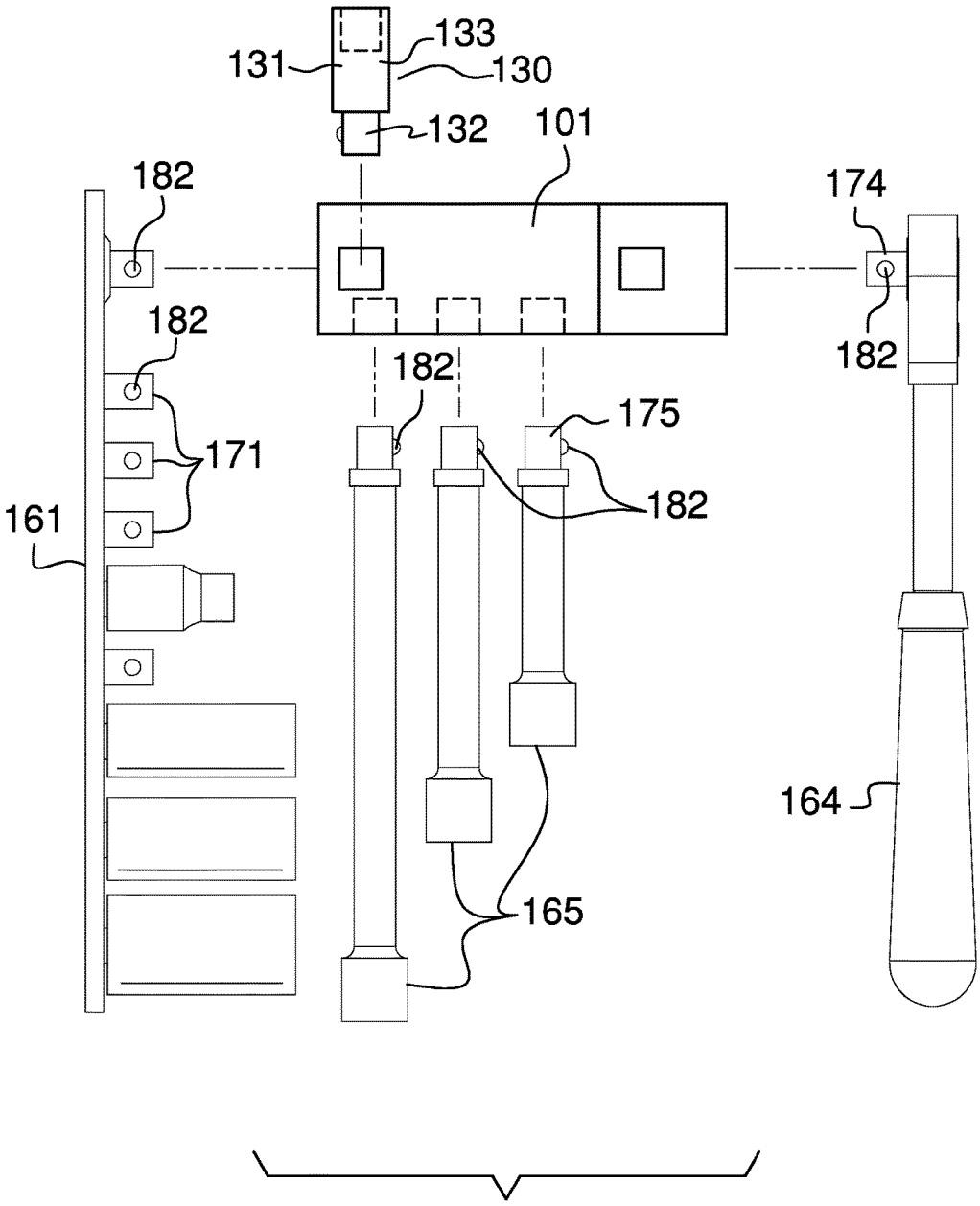
FIG. 5 is a top in-use view of an embodiment of the disclosure.

Detailed reference will now be made to one or more potential embodiments of the disclosure, which are illustrated in FIGS. 1 through 5.

The socket wrench storage case 100 (hereinafter invention) is a storage apparatus. The invention 100 is configured for use with a socket wrench handle 164. The socket wrench handle 164 is further defined with a wrench handle drive fitting 174. The invention 100 is configured for use with a socket wrench extension 165. The socket wrench extension 165 is further defined with a wrench extension drive fitting 175. The invention 100 is configured for use with a first socket rail 161. The first socket rail 161 is further defined with a first socket rail 161 drive fitting 171. The invention 100 is configured for use with a second socket rail. The second socket rail is further defined with a second socket rail drive fitting. The invention 100 is configured for use with a third socket rail. The third socket rail is further defined with a third socket rail drive fitting. The invention 100 comprises a rectilinear block 101, a plurality of ports 102, and one or more adaptors 103. The one or more adaptors 103 are not anticipated to be provisioned with the invention 100 but are instead standard adapters and extensions commonly provisioned with commercially available socket sets. The plurality of ports 102 are formed in the rectilinear block 101. Each of the plurality of ports 102 is configured to receive a drive fitting selected from the group consisting of a drive fitting of an individual adaptor 130 selected from the one or more adaptors 103, the wrench handle drive fitting 174, and the wrench extension drive fitting 175. Each individual adaptor 130 selected from the one or more adaptors 103 attaches the rectilinear block 101 to a drive fitting selected from the group consisting of the first socket rail 161 drive fitting 171, the second socket rail drive fitting, and the third socket rail drive fitting.

The rectilinear block 101 is the structure to which the first socket rail 161, the socket wrench handle 164, the socket wrench extension 165 and subsequent socket rails attach. The rectilinear block 101 has a structure that comprises two rectangular blocks attached to each other. The rectilinear block 101 comprises a master rectangular block 111 and a handle rectangular block 112. The master rectangular block 111 is further defined with a first face 141, a second face 142, a third face 143, a fourth face 144, a fifth face 145, and a sixth face 146. The handle rectangular block 112 is further defined with a seventh face 147 and an eighth face 148. The handle rectangular block 112 is further defined with the following faces which are shared with the master rectangular block 111: the third face 143, the fourth face 144, the fifth face 145, and the sixth face 146.

The master rectangular block 111 is an inert structure. The master rectangular block 111 is formed in the shape of a rectangular block. The master rectangular block 111 has formed in it a first sub-plurality of ports selected from the plurality of ports 102. The handle rectangular block 112 is an inert structure. The handle rectangular block 112 is formed in the shape of a rectangular block. The handle rectangular block 112 has formed in it a second sub-plurality of ports selected from the plurality of ports 102.

In the first potential embodiment of the disclosure, the first face 141 is the face of the master rectangular block 111 that is distal from the handle rectangular block 112. The sixth face 146 is the shared face along which the handle rectangular block 112 attaches to the master rectangular block 111. The second face 142 is the face of the master rectangular block 111 that is distal from the fourth face 144. The seventh face 147 is the face of the handle rectangular block 112 that is distal from the fourth face 144. The second face 142 is parallel to the seventh face 147. The eighth face 148 is the face of the handle rectangular block 112 that is distal from the first face 141.

The third face 143 is a shared face that is distal from the fifth face 145. The third face 143 is geometrically identical to the fifth face 145. The span of the distance of the third face 143 from the fourth face 144 to the seventh face 147 is less than the span of the distance from the fourth face 144 to the second face 142. The span of the distance of the fifth face 145 from the fourth face 144 to the seventh face 147 is less than the span of the distance from the fourth face 144 to the second face 142. In this manner, the first face 141, the second face 142, the third face 143, the fourth face 144, the fifth face 145, the sixth face 146, the seventh face 147, and the eighth face 148 are arranged to create the rectilinear block 101 form factor of the rectilinear block 101.

Each of the plurality of ports 102 forms a port that is sized to receive a drive fitting selected from the group consisting of: 1) the wrench handle drive fitting 174 of the socket wrench handle 164; 2) the wrench extension drive fitting 175 of the socket wrench extension 165; and, 3) adaptor drive fitting 132 of the individual adaptor 130. Each individual adaptor 130 attaches to the first socket rail 161 drive fitting 171 of the first socket rail 161 as well as any subsequent drive fittings selected from any subsequent socket rails to the invention 100.

Each of the plurality of ports 102 is a negative space that forms a cavity in a face of the rectilinear block 101. The span of the inner dimension of each of the plurality of ports 102 is greater than the span of the outer dimension of each selected drive fitting such that the selected drive fitting can be inserted into any port selected from the plurality of ports 102. The size of the span of the inner dimension of each of the plurality of ports 102 varies based on the size of the wrench set intended for use with the invention 100.

Each boundary surface that forms the lateral face of the negative space that forms each of the plurality of ports 102 is further defined with a ball channel 181. The ball channel 181 is a groove that is sized to receive the spring loaded ball lock 182 of any individual adaptor 130 stored within a port selected from the plurality of ports 102. The ball channel 181 is used to secure the individual adaptor 130 in the selected port. Each of the ball channels 181 contained within a selected port are positioned such that the individual adaptor 130 can be inserted into the selected port regardless of the orientation of the spring loaded ball lock 182.

The form factor of each of the plurality of ports 102 is identical within an instantiation of the invention 100.

The plurality of ports 102 comprises a first drive port 121, a second drive port 122, a third drive port 123, a fourth drive port 124, a fifth drive port 125, a sixth drive port 126, a seventh drive port 127, and an eighth drive port 128.

The first face 141 contains the first drive port 121. The second face 142 contains the second drive port 122. The fourth face 144 contains the third drive port 123. The fifth face 145 contains the fourth drive port 124, the fifth drive port 125, and the sixth drive port 126. The seventh face 147 contains the seventh drive port 127. The eighth face 148 contains the eighth drive port 128. The fourth drive port 124, the fifth drive port 125, and the sixth drive port 126 are positioned on the fifth face 145 such that the centers of the fourth drive port 124, the fifth drive port 125, and the sixth drive port 126 are aligned in a line that is parallel to the brink formed by the fourth face 144 and the fifth face 145.

Each of the one or more adaptors 103 attaches the first socket rail 161 (and any subsequent socket rails) to a port selected from the plurality of ports 102. Each of the one or more adaptors 103 comprises an extension structure 131 that separates the rectilinear block 101 from the first socket rail 161 such that any sockets stored on the first socket rail 161 will fit between the rectilinear block 101 and the first socket rail 161. The one or more adaptors 103 comprises a set of individual adaptors 130. Each rail socket attached to the rectilinear block 101 requires an individual adaptor 130 to make the attachment.

The individual adaptor 130 attaches the first socket rail 161 (or subsequent socket rails) to the rectilinear block 101. Each individual adaptor 130 comprises the extension structure 131, an adaptor drive fitting 132, and an adaptor drive port 133.

The extension structure 131 is a rectangular block structure. The extension structure 131 forms the inert structure that extends the span of distance between the rectilinear block 101 and the first socket rail 161 during the use of the invention 100.

The adaptor drive fitting 132 is a drive fitting that attaches to a face of the extension structure 131. The outer dimension of the adaptor drive fitting 132 is sized such that the adaptor drive fitting 132 will fit into any port selected from the plurality of ports 102. The adaptor drive fitting 132 attaches the individual adaptor 130 to the rectilinear block 101 when the adaptor drive fitting 132 inserts into the selected port.

The adaptor drive port 133 is a negative space that is formed in the face of the extension structure 131 that is distal from the adaptor drive fitting 132. The adaptor drive port 133 receives the first socket rail 161 drive fitting 171 (or subsequent drive fittings) from the first socket rail 161 to attach the first socket rail 161 to the individual adaptor 130.

In the first potential embodiment of the disclosure, the applicant anticipates that: 1) a wrench handle drive fitting 174 selected from the socket wrench handle 164 inserts into a port selected from the group consisting of the seventh drive port 127 and the eighth drive port 128; 2) a wrench extension drive fitting 175 selected from the socket wrench extension 165 inserts into a port selected from the group consisting of the fourth drive port 124, the fifth drive port 125, and the sixth drive port 126; 3) a first socket rail 161 drive fitting 171 selected from the first socket rail 161 inserts into the first drive port 121; 4) a second socket rail drive fitting selected from the second socket rail inserts into the second drive port 122; and, 5) a third socket rail drive fitting selected from the third socket rail inserts into the third drive port 123.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bolt: As used in this disclosure, a bolt is a cylindrical shaft formed with an exterior screw thread. A bolt is defined with an outer diameter.

Brink: As used in this disclosure, a brink refers to the discontinuous edge or line formed by the intersection of a first plane or surface and a second plane or surface wherein a cant exists between the first plane or surface and the second plane or surface.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Correspond: As used in this disclosure, the term correspond is used as a comparison between two or more objects wherein one or more properties shared by the two or more objects match, agree, or align within acceptable manufacturing tolerances.

Extension Structure: As used in this disclosure, an extension structure is an inert physical structure that is used to extend the span of the distance between any two objects.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Handle: As used in this disclosure, a handle is an object by which a tool, object, or door is held or manipulated with the hand.

Hex Socket: As used in this disclosure, a hex socket is a cylindrical pipe that is designed to receive the head of a hexagonal fastening device such as a bolt or a nut. The hex socket fits over and secures the hexagonal fastening device such that the hex socket can rotate the hexagonal fastening device to create or disconnect a threaded connection. Hexagonal fastening devices are also referred to as six-point fasteners. Always use socket Inner Dimension: As used in this disclosure, the term inner dimension describes the span from a first inside or interior surface of a container to a second inside or interior surface of a container. The term is used in much the same way that a plumber would refer to the inner diameter of a pipe.

Instantiation: As used in this disclosure, an instantiation refers to a specific physical object that is created using a specification.

Lever: As used in this disclosure, a lever is a simple machine that comprises a shaft that rotates around a fulcrum or pivot point.

Negative Space: As used in this disclosure, negative space is a method of defining an object through the use of open or empty space as the definition of the object itself, or, through the use of open or empty space to describe the boundaries of an object.

Nut: As used in this disclosure, a nut is a first object that is formed with a cylindrical negative space that further comprises an interior screw thread such that a second object with a matching exterior screw thread can screwed into the first object forming a threaded connection. A nut is further defined with an inner diameter.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Plug: As used in this disclosure, a plug is an object that is used: 1) as a barrier to block access to a cavity or an aperture; or, 2) a connection device that is inserted into a port, cavity, or aperture for the purpose of attaching a first object to a second object.

Port: As used in this disclosure, a port is a cavity formed in an object that is adapted to receive a plug.

Ratchet: As used in this disclosure, a ratchet is a device comprising a pawl or hinged catch that engages the sloping teeth of a wheel or bar permitting motion in one direction only.

Rectangular Block: As used in this disclosure, a rectangular block refers to a three-dimensional structure comprising six rectangular surfaces formed at right angles. Within this disclosure, a rectangular block may further comprise rounded edges and corners.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Rectilinear Block: As used in this disclosure, a rectilinear block refers to a three-dimensional structure comprising a plurality of rectangular surfaces. Rectilinear blocks are similar to rectangular blocks and are often used to create a structure with a reduced interior volume relative to a rectangular block. Within this disclosure, a rectilinear block may further comprise rounded edges and corners.

Screw: As used in this disclosure, to screw is a verb meaning: 1) to fasten or unfasten (unscrew) a threaded connection; or 2) to attach a helical structure to a solid structure.

Slot: As used in this disclosure, a slot is a long narrow groove, or aperture that is formed in an object.

Socket: As used in this disclosure, a socket is an opening or cavity that is configured to receive an inserted component.

Socket Wrench: As used in this disclosure, a socket wrench is a tool that is used to drive the rotation of a hardware item into a threaded connection. A socket wrench comprises a series of interchangeable structures, called sockets, and a handle. The socket fits over the hardware item. The handle provides leverage that allows the handle to rotate the socket and the hardware item. The connection of the socket to the handle is typically fitted with a ratchet. An example of a hardware item suitable for use with a socket wrench includes, but is not limited to, a bolt being driven into a nut. A hex socket is a common example of the type of socket used on a socket wrench. The handle of the socket wrench comprises a drive fitting that inserts into a port formed on each interchangeable socket to connect the socket into the handle.

Threaded Connection: As used in this disclosure, a threaded connection is a type of fastener that is used to join a first tube-shaped and a second tube-shaped object together. The first tube-shaped object is fitted with a first fitting selected from an interior screw thread or an exterior screw thread. The second tube-shaped object is fitted with the remaining screw thread. The tube-shaped object fitted with the exterior screw thread is placed into the remaining tube-shaped object such that: 1) the interior screw thread and the exterior screw thread interconnect; and, 2) when the tube-shaped object fitted with the exterior screw thread is rotated the rotational motion is converted into linear motion that moves the tube-shaped object fitted with the exterior screw thread either into or out of the remaining tube-shaped object. The direction of linear motion is determined by the direction of rotation.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A storage arrangement for tools comprising:

wherein the storage arrangement for tools comprises a rectilinear block, a plurality of ports, and one or more adaptors;

wherein the plurality of ports are formed in the rectilinear block;

wherein the one or more adaptors comprises a set of individual adaptors;

wherein the storage arrangement is a storage apparatus;

wherein the storage arrangement for tools is configured for use with a socket wrench handle;

wherein the socket wrench handle is further defined with a wrench handle drive fitting;

wherein the storage arrangement for tools is configured for use with a socket wrench extension;

wherein the socket wrench extension is further defined with a wrench extension drive fitting;

wherein the storage arrangement for tools is configured for use with a first socket rail;

wherein the first socket rail is further defined with a first socket rail drive fitting;

wherein the storage arrangement for tools is configured for use with a second socket rail;

wherein the second socket rail is further defined with a second socket rail drive fitting;

wherein the storage arrangement for tools is configured for use with a third socket rail;

wherein the third socket rail is further defined with a third socket rail drive fitting;

wherein each of the plurality of ports is configured to receive a drive fitting selected from the group consisting of a drive fitting of the individual adaptor selected from the one or more adaptors, the wrench handle drive fitting, and the wrench extension drive fitting;

wherein each selected drive fitting further comprises a spring loaded ball lock;

wherein each individual adaptor selected from the one or more adaptors attaches the rectilinear block to a drive fitting selected from the group consisting of the first socket rail drive fitting, the second socket rail drive fitting, and the third socket rail drive fitting;

wherein the rectilinear block is the structure to which the first socket rail, the socket wrench handle, the socket wrench extension and subsequent socket rails attach;

wherein the rectilinear block comprises a master rectangular block and a handle rectangular block;

wherein the handle rectangular block attaches to the master rectangular block;

wherein the master rectangular block is further defined with a first face, a second face, a third face, a fourth face, a fifth face, and a sixth face;

wherein the handle rectangular block is further defined with a seventh face and an eighth face;

wherein the handle rectangular block is further defined with the following faces which are shared with the master rectangular block: the third face, the fourth face, the fifth face, and the sixth face;

wherein the master rectangular block is an inert structure;

wherein the master rectangular block is formed in the shape of a rectangular block;

wherein the master rectangular block has formed in it a first sub-plurality of ports selected from the plurality of ports;

wherein the handle rectangular block is an inert structure;

wherein the handle rectangular block is formed in the shape of a rectangular block;

wherein the handle rectangular block has formed in it a second sub-plurality of ports selected from the plurality of ports;

wherein the first face, the second face, the third face, the fourth face, the fifth face, the sixth face, the seventh face, and the eighth face combine to form the rectilinear block form factor of the rectilinear block;

wherein the sixth face is the shared face along which the handle rectangular block attaches to the master rectangular block;

wherein the second face is the face of the master rectangular block that is distal from the fourth face;

wherein the seventh face is the face of the handle rectangular block that is distal from the fourth face;

wherein the second face is parallel to the seventh face;

wherein the third face is a shared face that is distal from the fifth face;

wherein the third face is geometrically identical to the fifth face;

wherein the span of the distance of the third face from the fourth face to the seventh face is less than the span of the distance from the fourth face to the second face;

wherein the span of the distance of the fifth face from the fourth face to the seventh face is less than the span of the distance from the fourth face to the second face.

2. The storage arrangement for tools according to claim 1 wherein each of the plurality of ports is a negative space that forms a cavity in a face of the rectilinear block;

wherein the span of the inner dimension of each of the plurality of ports is greater than the span of the outer dimension of each selected drive.

3. The storage arrangement for tools according to claim 2 wherein each port selected from the plurality of ports receives a drive fitting selected from the group consisting of: A) the wrench handle drive fitting of the socket wrench handle; B) the wrench extension drive fitting of the socket wrench extension; and, C) adaptor drive fitting of the individual adaptor.

4. The storage arrangement for tools according to claim 3 wherein each boundary surface that forms the lateral face of the negative space that forms each of the plurality of ports is further defined with a ball channel;

wherein the ball channel is a slot that is sized to receive the spring loaded ball lock of the selected drive fitting stored within a port selected from the plurality of ports;

wherein the ball channel secures the selected drive fitting in the selected port;

wherein each of the ball channels contained within a selected port are positioned such that the selected drive fitting inserts into the selected port regardless of the orientation of the spring loaded ball lock.

5. The storage arrangement for tools according to claim 4 wherein the form factor of each of the plurality of ports is identical within an instantiation of the storage arrangement for tools.

6. The storage arrangement for tools according to claim 5 wherein the plurality of ports comprises a first drive port, a second drive port, a third drive port, a fourth drive port, a fifth drive port, a sixth drive port, a seventh drive port, and an eighth drive port;

wherein the first face contains the first drive port;

wherein the second face contains the second drive port;

wherein the fourth face contains the third drive port;

wherein the fifth face contains the fourth drive port, the fifth drive port, and the sixth drive port;

wherein the seventh face contains the seventh drive port;

wherein the eighth face contains the eighth drive port.

7. The storage arrangement for tools according to claim 6 wherein the fourth drive port, the fifth drive port, and the sixth drive port are positioned on the fifth face such that the centers of the fourth drive port, the fifth drive port, and the sixth drive port are aligned in a line that is parallel to the brink formed by the fourth face and the fifth face.

8. The storage arrangement for tools according to claim 7 wherein the individual adaptor attaches the selected socket rail to the rectilinear block;

wherein each selected rail socket attached to the rectilinear block requires an individual adaptor to make the attachment.

9. The storage arrangement for tools according to claim 8 wherein the individual adaptor comprises an extension structure;

wherein the extension structure is a rectangular block structure;

wherein the extension structure separates the rectilinear block from a socket rail selected from the group consisting of the first socket rail, the second socket rail, and the third socket rail.

10. The storage arrangement for tools according to claim 9 wherein each individual adaptor further comprises an adaptor drive fitting, and an adaptor drive port;

wherein the adaptor fitting attaches to the extension structure;

wherein the adaptor drive port is formed in the extension structure.

11. The storage arrangement for tools according to claim 10 wherein the adaptor drive fitting is a drive fitting;

wherein the adaptor drive fitting attaches to a face of the extension structure;

wherein the outer dimension of the adaptor drive fitting is sized such that the adaptor drive fitting will fit into any port selected from the plurality of ports;

wherein the adaptor drive fitting attaches the individual adaptor to the rectilinear block when the adaptor drive fitting inserts into the selected port.

12. The storage arrangement for tools according to claim 11 wherein the adaptor drive port is a negative space;

wherein the adaptor drive port is formed in the face of the extension structure that is distal from the adaptor drive fitting;

wherein the adaptor drive port receives the socket rail drive fitting of the first socket rail.

13. The storage arrangement for tools according to claim 12 wherein a wrench handle drive fitting selected from the socket wrench handle inserts into a port selected from the group consisting of the seventh drive port and the eighth drive port.

14. The storage arrangement for tools according to claim 13 wherein the wrench extension drive fitting selected from the socket wrench extension inserts into a port selected from the group consisting of the fourth drive port, the fifth drive port, and the sixth drive port.

15. The storage arrangement for tools according to claim 14 wherein the first socket rail drive fitting selected from the first socket rail inserts into the first drive port;

wherein the second socket rail drive fitting selected from the second socket rail inserts into the second drive port;

wherein the third socket rail drive fitting selected from the third socket rail inserts into the third drive port.

* * * * *